US008297951B2

(12) United States Patent
Peia

(10) Patent No.: US 8,297,951 B2
(45) Date of Patent: Oct. 30, 2012

(54) FAN HAVING A PRINTED CIRCUIT BOARD

(75) Inventor: Rodica Peia, Zimmern (DE)

(73) Assignee: EBM-Papst St. Georgen GmbH & Co. KG, St. Georgen (DE)

( * ) Notice: Subject to any disclaimer, the term of this patent is extended or adjusted under 35 U.S.C. 154(b) by 169 days.

(21) Appl. No.: 12/596,122

(22) PCT Filed: Jun. 21, 2008

(86) PCT No.: PCT/EP2008/005029

§ 371 (c)(1),
(2), (4) Date: Oct. 15, 2009

(87) PCT Pub. No.: WO2009/000481

PCT Pub. Date: Dec. 31, 2008

(65) Prior Publication Data

US 2010/0143170 A1 Jun. 10, 2010

(30) Foreign Application Priority Data

Jun. 28, 2007 (DE) ..... 20 2007 009 407 U
Feb. 26, 2008 (DE) ..... 20 2008 003 033 U

(51) Int. Cl.
*F04D 25/06* (2006.01)
*F04D 25/08* (2006.01)
*F04D 27/00* (2006.01)

(52) U.S. Cl. ..... 417/423.14; 417/44.1; 417/423.1; 361/694; 310/67 R

(58) Field of Classification Search ..... 417/44.1, 417/423.1, 423.14; 361/694, 695; 310/68 B, 310/71, 156.05, 156.06, 67 R
See application file for complete search history.

(56) References Cited

U.S. PATENT DOCUMENTS

| | | | | |
|---|---|---|---|---|
| 6,013,966 | A * | 1/2000 | Fehrenbacher et al. | 310/257 |
| 2005/0098641 | A1 * | 5/2005 | Ardelt et al. | 236/49.3 |
| 2006/0171801 | A1 * | 8/2006 | Manabe et al. | 415/176 |
| 2007/0134109 | A1 * | 6/2007 | Peia | 417/420 |

FOREIGN PATENT DOCUMENTS

| | | |
|---|---|---|
| DE | 20 2006002789 U | 4/1992 |
| DE | 29718 082 U | 2/1999 |
| DE | 20 2004 016545 | 12/2004 |
| EP | 501 198 B | 8/1995 |

* cited by examiner

*Primary Examiner* — Devon Kramer
*Assistant Examiner* — Dominick L Plakkoottam
(74) *Attorney, Agent, or Firm* — Milton Oliver, Esq.; Oliver Intellectual Property

(57) ABSTRACT

A fan (20) has: a motor having a stator (40) and having a rotor (60) with at least one fan blade; at least one air inlet having an air entrance opening (102) for the inlet of air; at least one air outlet having an air exit opening (32) for the outlet of air; a circuit board (80) having at least one recess, which circuit board (80) is arranged in the region of the air inlet in such a way that air can enter the fan (20) through the recess, motor electronics (88) being arranged on the circuit board (80). In a preferred embodiment, a Negative Temperature Coefficient (NTC) resistor (84) is surface-mounted on a PC board portion (83) extending into the air passage, to thereby sense air temperature. This facilitates compact, automated construction.

25 Claims, 14 Drawing Sheets

FAN HAVING A PRINTED CIRCUIT BOARD

CROSS-REFERENCE TO RELATED APPLICATION(S)

This application is a section 371 of PCT/EP08/05029, filed 2008-06-21, which in turn claims priority from German applications DE 20 2007 009 407.8, filed 2007-06-28, and DE 20 2008 003 033.1, filed 2008-02-26.

FIELD OF THE INVENTION

The invention relates to a fan having a circuit board, in particular for air measurement, for example for air conditioning systems in vehicles.

BACKGROUND

DE 20 2004 016 545 U1, and corresponding to US 2005-098 641-A, on which I am named as a co-inventor, show a fan in which a sensor is arranged on a circuit board in the region of the air entrance opening, and in which electronic components are arranged on a circuit board region that is arranged laterally on the fan.

SUMMARY OF THE INVENTION

It is an object of the invention to make a novel fan available.

According to the invention, the object is achieved by configuring a housing of the fan to define an air inlet opening, an air outlet opening, and an electronic component circuit board mounting location therebetween, forming a recess in the circuit board, and permitting air to enter the fan through that recess.

Arrangement of the motor electronics in the region of the air inlet has several advantages. The motor electronics are prevented from covering a portion of the air outlets, the overall height or width of the fan is not substantially influenced, and construction of the fan is simple and easy to automate.

The invention is likewise achieved by forming the fan with at least one guidance element, protruding therefrom, and serving to guide the circuit board into place.

BRIEF FIGURE DESCRIPTION

Further details and advantageous refinements of the invention are evident from the exemplifying embodiments, in no way to be understood as a limitation of the invention, that are described below and depicted in the drawings.

DETAILED DESCRIPTION

Figure 1:
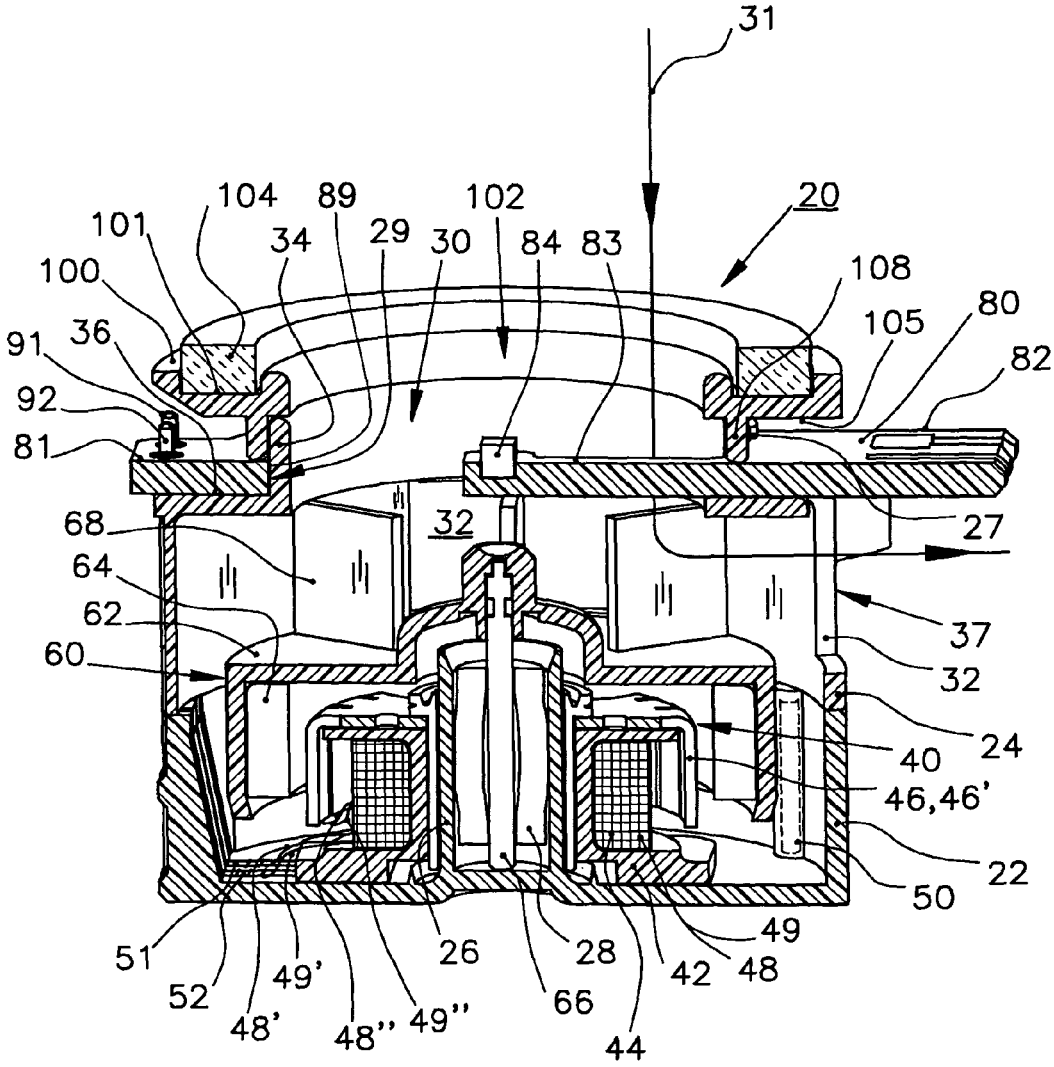
FIG. 1 is a section through a preferred embodiment of a fan according to the present invention.

In the description that follows, the same reference characters are used for identical or identically functioning parts, and the latter are usually described only once.

FIG. 1 shows a fan 20. The latter has, for example, an outside diameter of 30 mm and a height of 28 mm, and is shown greatly enlarged so that details can be depicted.

Fan 20 has a lower housing part (base part, support part) 22 and an upper housing part (air guidance part) 24 that is connected to lower housing part 22, for example by an adhesive connection, welded connection, latching connection, and/or a snap connection. Provided on fan 20, and preferably on the lower side of lower housing part 22, are connecting elements 25 for mounting fan 20 on a circuit board or on a housing part, for example in the form of latch elements such as, for example, latching studs and/or latching hooks.

Lower housing part 22 has at the center a bearing support tube 26 into which a sintered bearing 28 is pressed. Alternatively, for example, one or more rolling bearings or a ceramic bearing could also be used as bearing 28. Arranged in the radially outer region of lower housing part 22 is at least one magnet 50 for generating a magnetic auxiliary torque that ensures a defined rotor position when no current is flowing through stator 40 and when rotor 60 is at rest.

Figure 3:
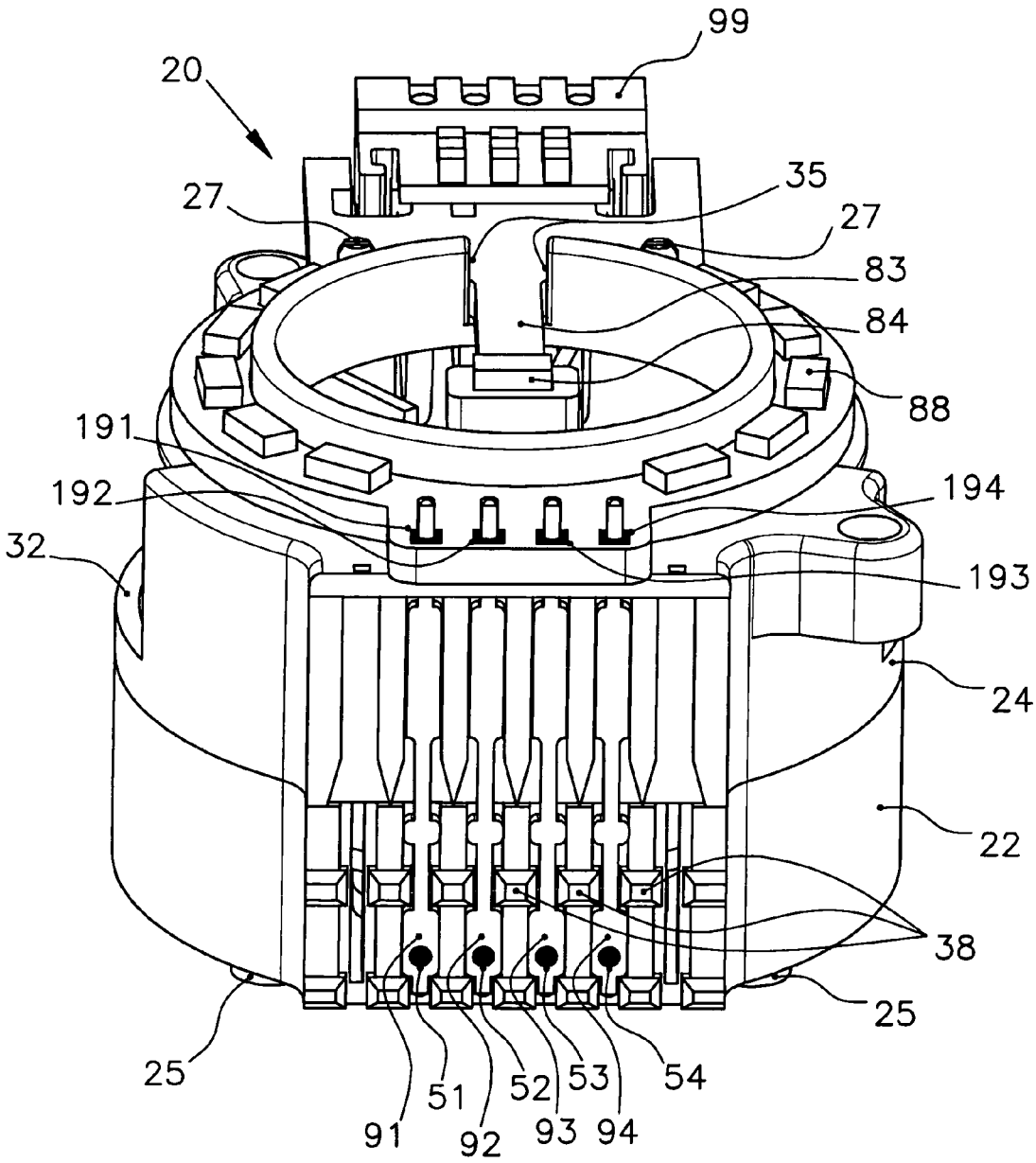
FIG. 3 is a three-dimensional depiction of the fan of FIG. 1 viewed from the side of the contact pins.

Mounted on the outer side of bearing support tube 26 is an internal stator 40 that has a support (coil former) 42 preferably produced from plastic, which support has a stator winding 44, an upper claw pole part 46, a lower claw pole part 46' rotated 90 degrees (not depicted), and four connector pins 51, 52, 53, and 54 (see FIG. 1 and FIG. 3) that are mounted in support 42 and protrude toward the outer side of lower housing 22.

Stator winding 44 has (indicated merely schematically) a drive strand 48 and a sensor coil 49 that are wound in circular fashion around bearing support tube 26 on support 42 in order to form, together with claw pole parts 46, 46', a claw pole stator 40.

Strand 48 serves as a drive strand to drive the motor, and has two terminals (ends) 48' and 48" that are electrically connected e.g. to terminal pins 51, 53 respectively. Coil 49 serves as a sensor coil to sense the rotor position for electronic commutation, and has two terminals (ends) 49', 49" that are electrically connected e.g. to terminal pins 52, 54, respectively. Only terminals 48' and 49', which are wound around terminal pins 51 and 52 and soldered to them, are depicted. The connection of ends 48', 48", 49', and 49" to terminal pins 51 to 54 preferably has a strain relief in order to prevent damage to the ends.

By preference, stator winding 44, claw pole parts 46, 46', and terminal pins 51 to 54 are preassembled on support 42, and the preassembled support 42 is then slid onto bearing support tube 26 and pressed, for example by way of four pegs (not depicted), into corresponding holes of lower housing part 22 for mechanical connection.

An external rotor 60 has a rotor cup 62 inside which is arranged an annular permanent magnet 64 that is magnetized in this exemplifying embodiment with four poles, since claw pole stator 40 also has four poles. Permanent magnet 64 is implemented, for example, as a plastic-matrix ferrite magnet ("rubber magnet") and is, for example, injection-molded or adhesively bonded into rotor 60, smaller tolerances being possible with injection-molding.

Figure 2:
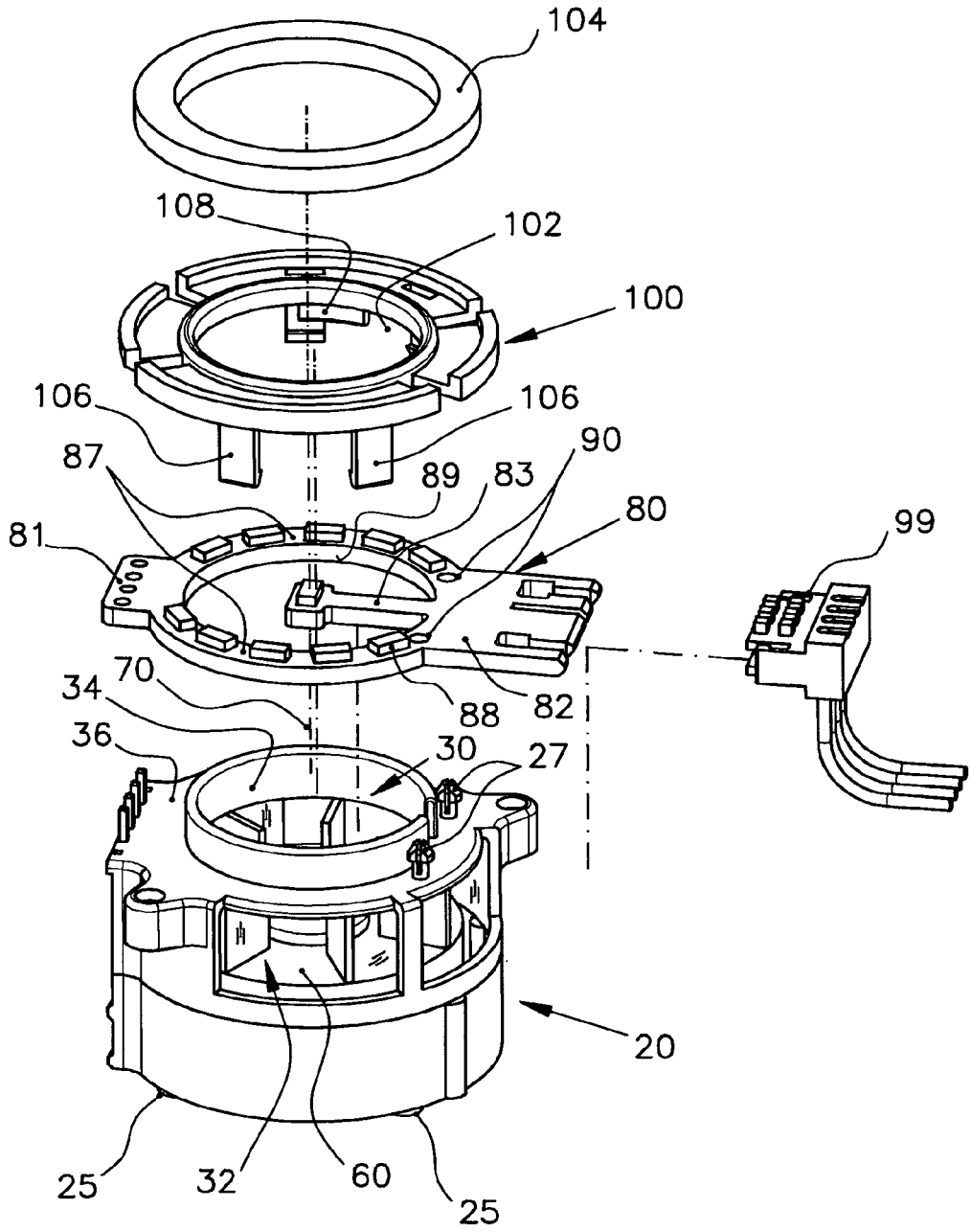
FIG. 2 is an exploded view of the fan of FIG. 1.

Mounted in rotor cup 62 is a shaft 66 that is journaled in sintered bearing 28 and can execute a rotation with respect to the motor axis or rotor axis 70 (FIG. 2). Shaft 66 can be implemented, for example, as a steel shaft or ceramic shaft, and mounting of shaft 66 in rotor cup 62 can be accomplished, for example, by pressing in or injection-molding. Shaft 66 abuts with its free end against lower housing part 22. Rotor magnet 64 is offset axially upward with respect to claw pole parts 46, 46', with the result that an axial force K acts on said magnet in the direction toward lower housing part 22 and presses shaft 66 against said part (so-called axial plain bearing with axial preload).

Substantially radially extending fan blades 68 of a radial fan are arranged on rotor cup 62. Fan blades 68 may also have a curvature in the running direction or opposite to the running direction of fan 20.

Upper housing part 24 has, at the top, a central air entrance opening 30 for substantially axial inlet of air 31, and at least one lateral air exit opening 32 for the substantially radial outlet of air 31. Upper housing part 24 forms a collar 34 at least on a part of the edge of air entrance opening 30, and said opening has a flat upper side 36 around collar 34.

A circuit board 80 is arranged on the flat upper side 36 of the upper housing part, and preferably above rotor 60 and stator 40. Circuit board 80 is arranged annularly around collar 34, and has an annular region 87 (FIG. 2 and FIG. 9) having at least one recess 89. Circuit board 80 is arranged substantially perpendicularly (e.g. at between 75 and 105 degrees) with respect to motor axis 70 (FIG. 2). In FIG. 2 it is arranged perpendicularly.

Figure 9:
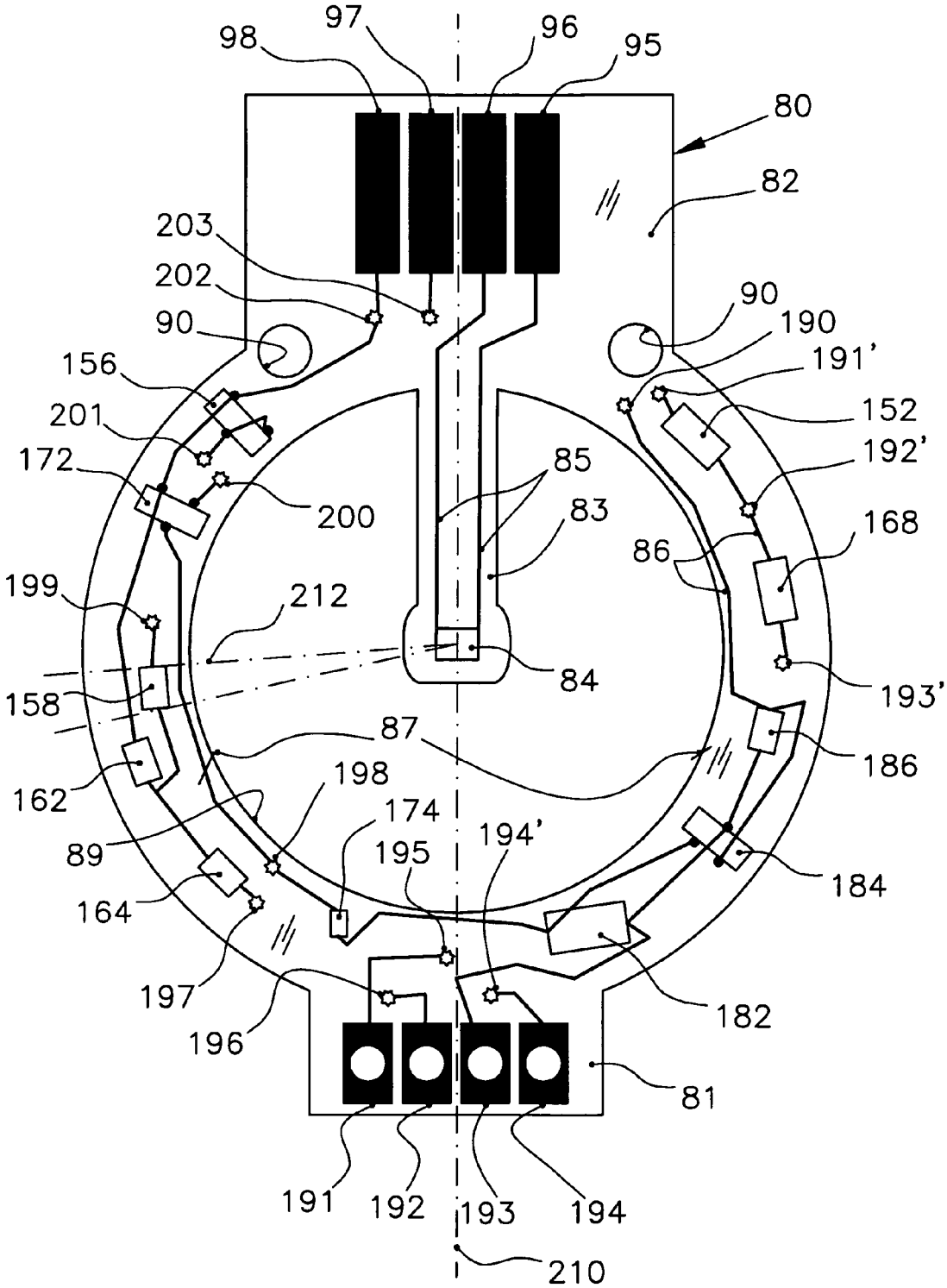
FIG. 9 shows a circuit board having the circuit of FIG. 8, from above.

At a first terminal region 81, it is connected to four axially extending contact pins 91, 92, 93, 94 mounted on the outer side of lower housing part 22 and of upper housing part 24, by the fact that said pins project, for example, through corresponding holes in circuit board 80 and are contacted, preferably soldered, on the upper side of circuit board 80 to corresponding contacts 191, 192, 193, and 194 (see FIG. 9). Contact pins 91 to 94 are connected, for example via a solder connection, to terminal pins 51 to 54 of stator 40, so that circuit board 80 is electrically connected to drive strand 48 and to sensor coil 49. Contact pins 91 to 94 are preferably also connected to housing 22 and 24 by plastic deformation of plastic housing parts 38 depicted e.g. in FIG. 3, and this is also referred to as "hot upsetting." A strain relief for contact pins 91 to 94 is also produced as a result.

Figure 4:
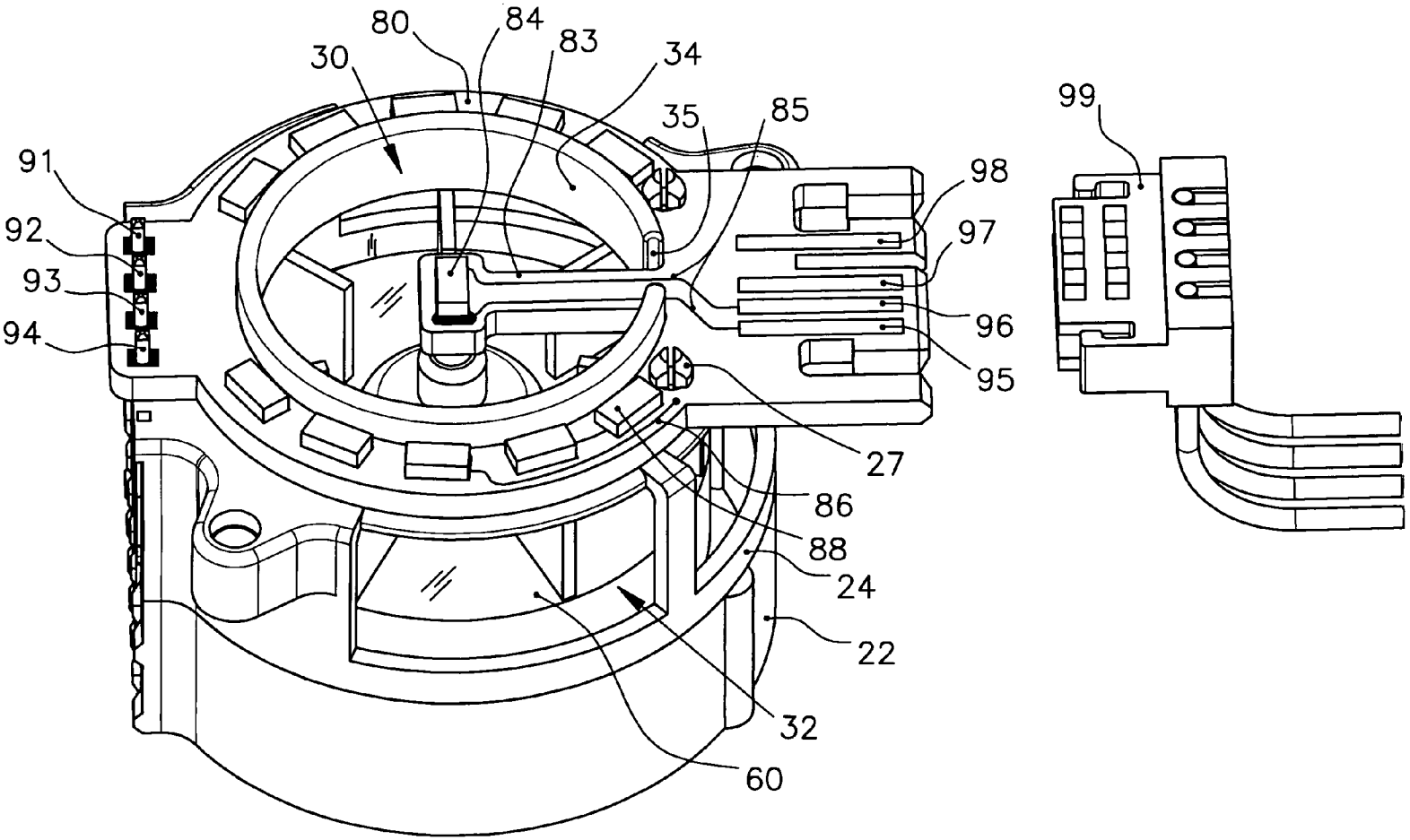
FIG. 4 is a three-dimensional depiction of the fan of FIG. 1, the circuit board being shown without its cover.
Figure 5:
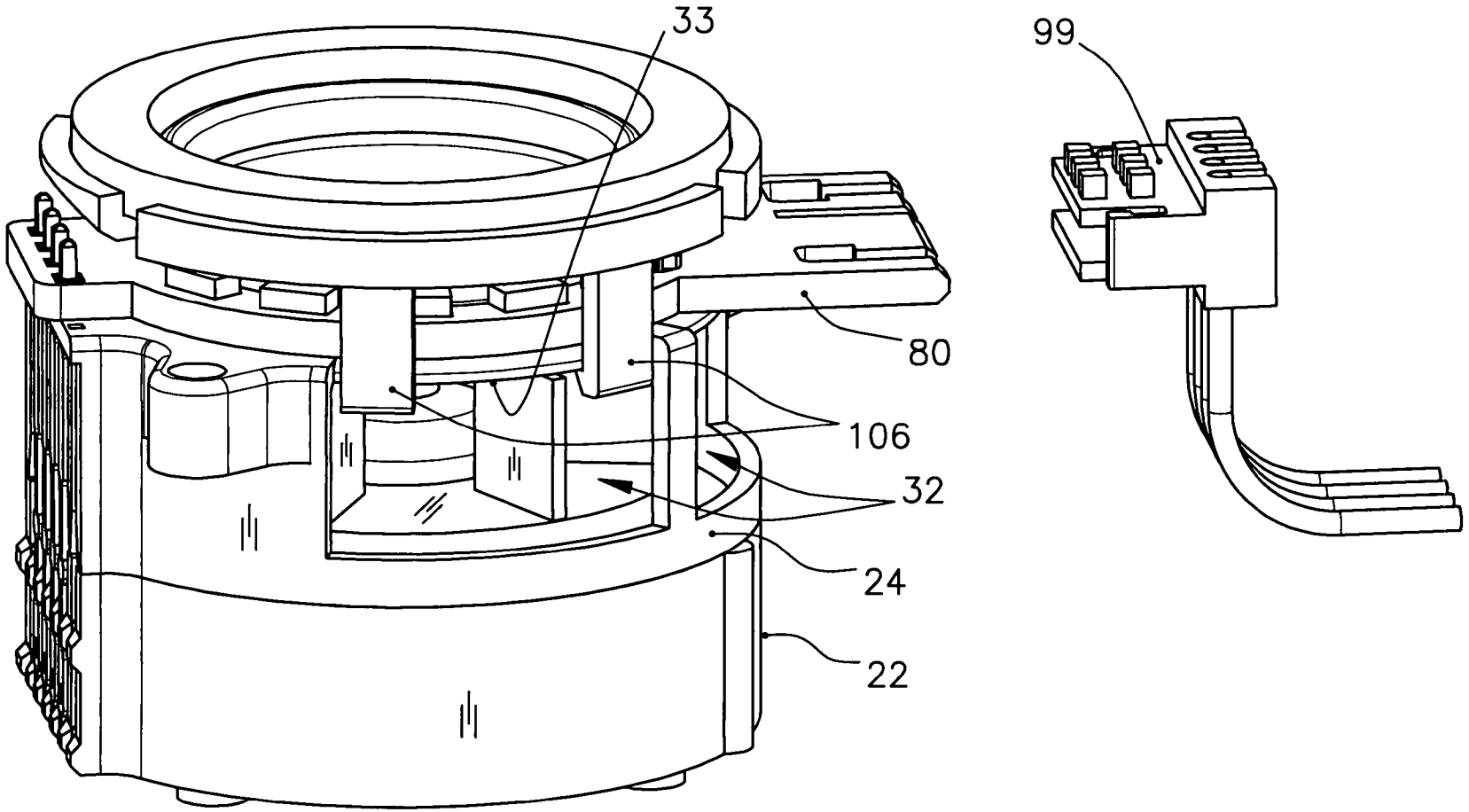
FIG. 5 is a three-dimensional depiction of the fan of FIG. 1 with the plug connector pulled out.
Figure 6:
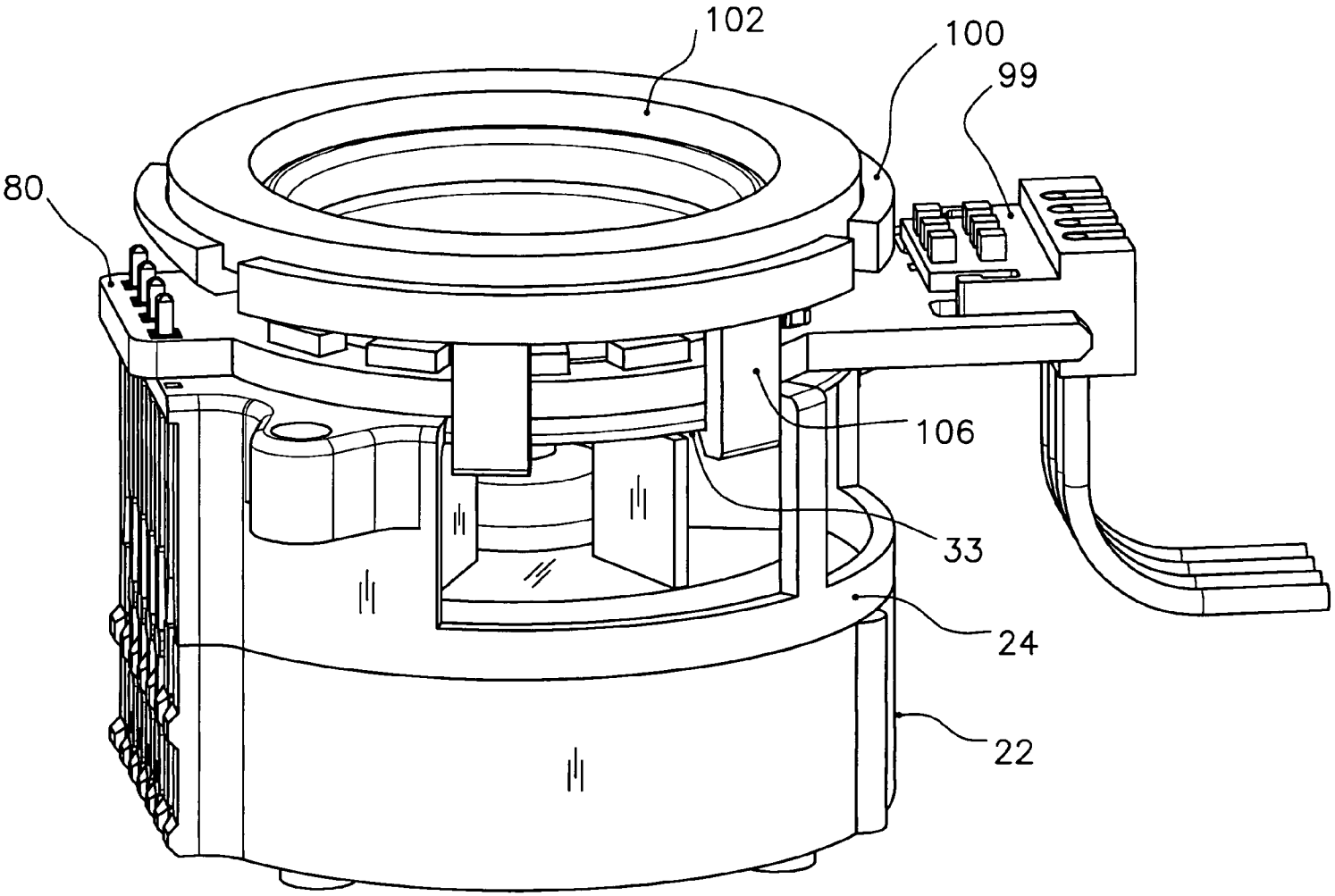
FIG. 6 is a three-dimensional depiction of the fan of FIG. 1 with the plug connector inserted.

Circuit board 80 furthermore has a second terminal region 82 on which, for example, a plug connector 99 having electrical terminals is mountable (see FIG. 2 to FIG. 6), the plug connector preferably having a safety latch for latching with corresponding latch-in regions (latch elements) in circuit board 80. Circuit board 80 is connected at second terminal region 82, via two latching hooks 27 projecting from upper housing part 24 and latched into corresponding cutouts 90 (FIG. 2) of circuit board 80, to said part. Four contacts 95 (first terminal to sensor 84), 96 (second terminal to sensor 84), 97 (supply voltage $+U_B$), and 98 (supply voltage ground) are preferably provided on the second terminal region. Second terminal region 82 is preferably located opposite first terminal region 81, and a strut-shaped circuit board portion 83 projects from the side of second terminal region 82 through an interruption 35 of collar 34 (FIG. 3), at least partly in the manner of a diving board, into air entrance opening 30. Alternatively, strut-shaped circuit board portion 83 may extend continuously to the opposite side. Arranged on strut-shaped circuit board portion 83 is a sensor 84, preferably of SMD (Surface Mounted Device) design and arranged centrally in air entrance opening 30. Sensor 84 is, for example, an NTC (Negative Temperature Coefficient) resistor for temperature measurement, and it is connected to two conductive tracks 85 (see FIG. 4 and FIG. 9).

Schematically indicated conductive tracks 86 and electrical/electronic components 88 are arranged on circuit board 80.

All of the motor electronics for electronically commutated fan 20, which for example evaluate the signal of sensor coil 49 and control current flow through drive strand 48 via an output stage, in order to produce a rotation of rotor 60, are preferably arranged on circuit board 80. For this purpose, circuit board 80 is preferably populated only with SMD components 88, and conductive tracks 86 are provided on both the upper side and the lower side of the circuit board, corresponding through-contacts being provided. Circuit board 80 preferably has a thickness of 2 mm+/−1 mm and has, in the annular region outside first terminal region 81 and second terminal region 82, an inside diameter in the range from 15 to 35 mm and an outside diameter in the range from 18 mm to 40 mm, the radial dimension between the inner and the outer edges of circuit board 80 preferably being in the range of 4 mm+/−2 mm. Circuit board 80 preferably extends radially, at maximum, as far as housing 22, 24, although first terminal region 81 and second terminal region 82 may protrude radially therebeyond (see FIG. 4). This reduces the risk of damage to the circuit board and to components 88 and conductive tracks 87 arranged thereon.

Rotation of rotor 60 having fan blades 68 causes air to be drawn in through air entrance opening 30 and air to be blown out through lateral openings 32. Air can thus, for example, be drawn out of the interior of a vehicle, and the air temperature can be measured by means of sensor 84 and delivered via contacts 95, 96 to an air conditioning system (not depicted).

Figure 7:
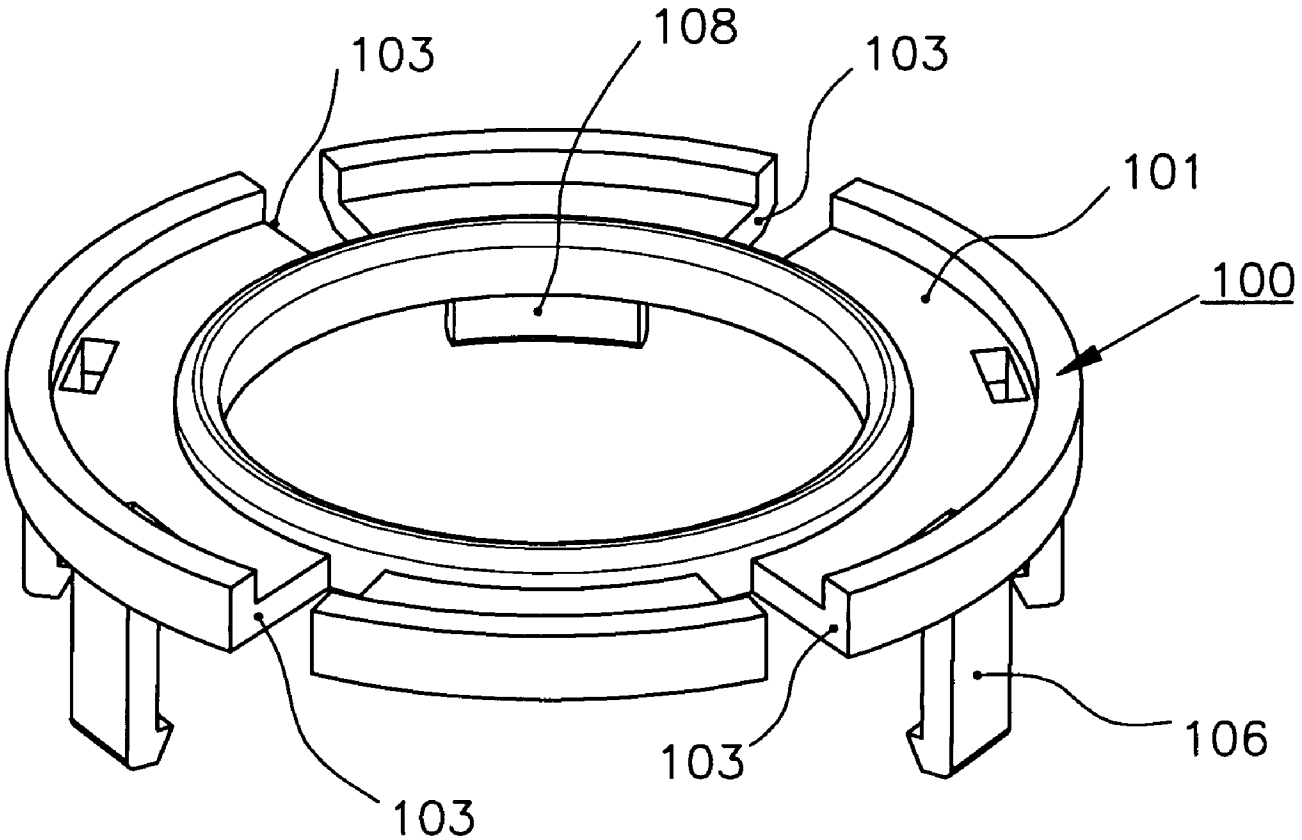
FIG. 7 is a three-dimensional depiction of a shaped part.

As is evident from FIG. 1, FIG. 2, FIG. 5, and FIG. 6, an annular, preferably round shaped part 100 (FIG. 7) having an air entrance opening 102 is placed on collar 34, which part extends the air entrance opening upward. Arranged on the upper part of shaped part 100, in a depression 101 on its bottom, is a foam-like annular sealing member 104 that protrudes axially out of depression 101 in order, for example, to enable a seal between fan 20 and a housing part (not depicted) having an air entrance opening. Shaped part 100 is arranged above circuit board 81 and covers electronic components 88 at least in part, preferably completely, with a region 105 in order to prevent mechanical damage to components 88. Shaped part 100 is braced at least in part on the inner edge of circuit board 80. Alternatively or additionally, shaped part 100 has downwardly protruding extensions 106 having latching hooks that enable retention on circuit board 80 and/or on upper housing part 24, in particular on upper edges 33 of lateral openings 32. Radial recesses 103 are provided in order to enable extensions 106 to move as a result of deflection of shaped part 100 (see FIG. 7). Mounting by adhesive bonding is also possible. Shaped part 100 has downwardly protruding extensions 108 that, inter alia, close off interruption 35 of the collar for strut-like circuit board portion 83 in order to avoid losses or incorrect measurements as a result of air passing through said interruption 35.

The region of shaped part 100 located above electronic components 88 is preferably at a distance from them in order to improve cooling thereof. The distance between the upper side of components 88 and the lower side of covering region 105 is preferably between 0.2 mm and 5 mm at least one point. The distance between the upper side of circuit board 80 and the lower side of covering region 105 is preferably between 0.8 mm and 7 mm at least one point.

Figure 8:
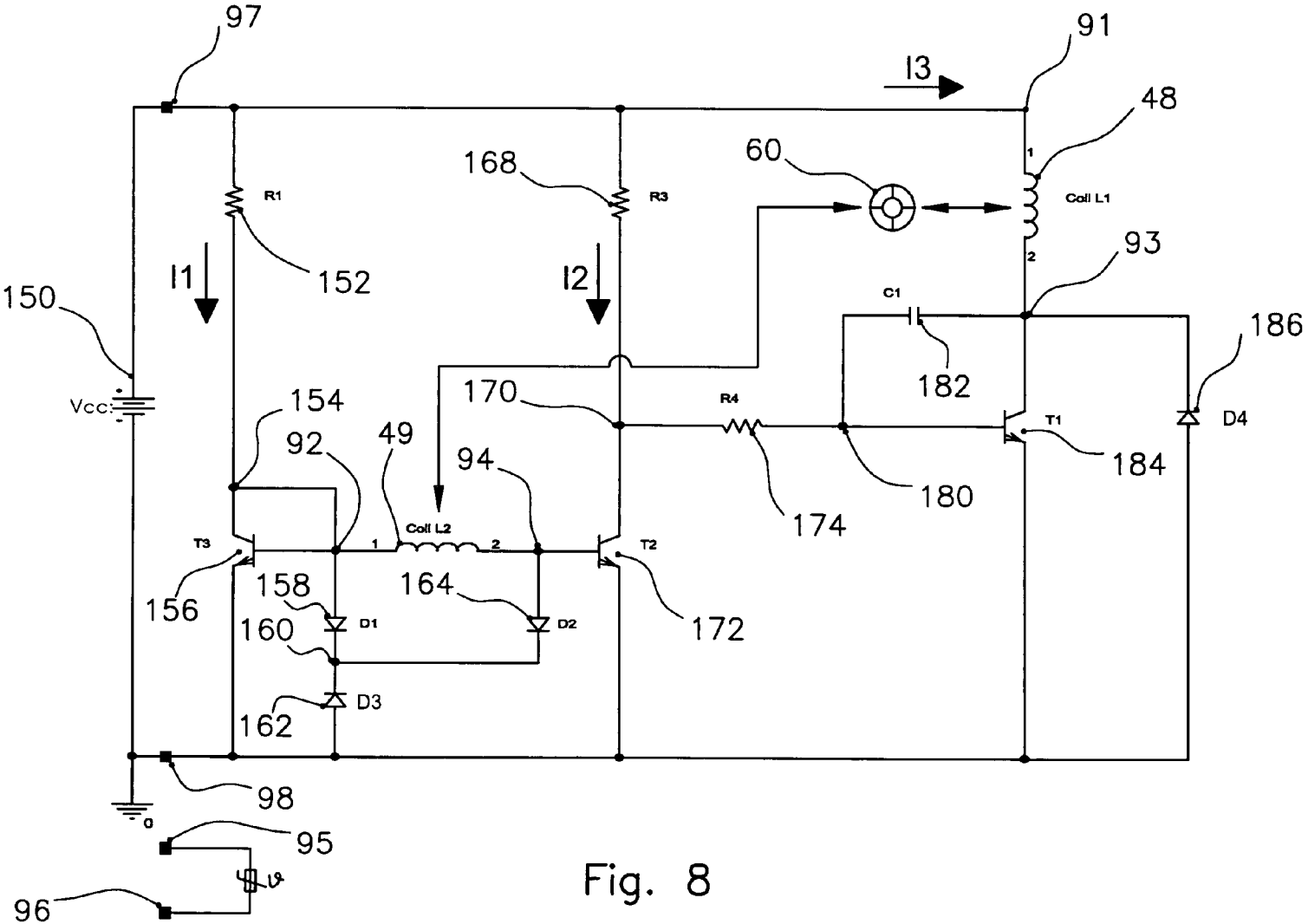
FIG. 8 shows a circuit for the fan of FIG. 1.

FIG. 8 shows an exemplifying embodiment of the motor electronics. Terminal 97 is connected to the positive pole of a voltage source Vcc 150, and terminal 98 is connected to its negative pole or to ground GND. A resistor 152 sits between point 97 and a point 154. Point 154 is connected to contact 92 and to the collector of an npn transistor 156. The base of transistor 156 is connected to point 92, and the emitter of transistor 156 is connected to contact 98 (GND). Sensor coil 49 is connected to contacts 92 and 94. There is a diode 158 between point 92 and a point 160, a diode 162 between contact 98 and point 160, and a diode 164 between points 94 and 160, the cathode facing in each case toward point 160. There is a resistor 168 between contact 97 and a point 170. The collector of an npn transistor 172 is connected to point 170, its base is connected to point 94, and its emitter is connected to contact 98 (GND). Contact 97 is connected to contact 91 of drive strand 48. Point 170 is connected via a resistor 174 to point 180, which in turn is connected via a capacitor 182 to contact 93 of drive strand 48. The base of an npn transistor 184 is connected to point 180, its collector is connected to point 93, and its emitter is connected to contact 98 (GND). Contact 93 is connected via a diode 186 to contact 98, its cathode facing toward point 93. Rotor 60 is operatively connected to drive strand 48 and to sensor coil 49.

NTC (Negative Temp. Coefficient) resistor 84 is connected to contacts 95, 96.

| COMPONENT LIST | |
|---|---|
| Transistor 156 | BC847C |
| Transistor 172 | BC847C |
| Transistor 184 | BC817-40 |
| Capacitor 182 | 220 nF |
| Resistor 152 | 33 kilohm |
| Resistor 186 | 10 kilohm |
| Resistor 174 | 360 kilohm |
| Diodes 158, 164 | BCX84C5V1 |
| Diode 162 | BAS216 |
| Diode 186 | BAS321 |
| Drive strand 48 | 127 ohm, n = 880 |
| Sensor coil 49 | 257 ohm, n = 880 |

Manner of Operation

The motor and the commutation electronics represent a single-strand, single-pulse drive system in which current flows through drive strand 38 over approx. 180° el. (electrical) in each case, while the strand remains currentless over the other approx. 180° el., the point in time for commutation being ascertained via sensor coil 49.

The motor can start up only in specific starting positions, and they are ensured by the magnetic auxiliary torques generated by the at least one magnet 50. The motor has a preferred rotation direction.

Diodes 158, 162, and 164 protect transistors 156, 172, and 184 from destruction, and diode 186 prevents mispolarity of the operating voltage.

Transistors 156, 172 form a so-called current mirror, and transistor 156 (designed as a diode) produces an exact bias voltage at the base of transistor 172. Hereinafter, current I1 denotes the current through resistor 152, current I2 the current through resistor 168, and current I3 the current through drive strand 48. Current I1 is determined by the applied operating voltage and by resistor 152. As long as no voltage is being induced in sensor coil 49 (rotation speed n=0), the base of transistor 156 and the base of transistor 172 are at the same potential as a result of sensor coil 49, and currents I1 and I2 are therefore of approximately the same magnitude. Once the operating voltage is switched on, however, the voltage at the base of transistor 184 (operating as output stage), which voltage is also determined by resistor 174 and by the collector of transistor 172, is minimally greater because of the asymmetry of resistors 168 and 152, and transistor 184 therefore switches on. Current therefore flows through drive strand 48, and rotor 60 begins to rotate.

A voltage is thereby induced in sensor coil 49, and upon the subsequent zero transition of this induced voltage (induced voltage becomes positive), transistor 172 becomes completely switched on. The potential at the base of transistor 184 is thereby reduced, and the consequence of this is that current no longer flows through drive strand 48. Because of the inertia of rotor 60, it continues to rotate until the next zero transition of the induced voltage (induced voltage becomes negative). Transistor 172 then blocks, and the consequence of this is that transistor 184 becomes conductive again and current flows through drive strand 48.

The points in time at which transistor 184 switches on and off are thus determined by the zero-passage points or transitions of the voltage induced in sensor coil 49.

Figure 10:
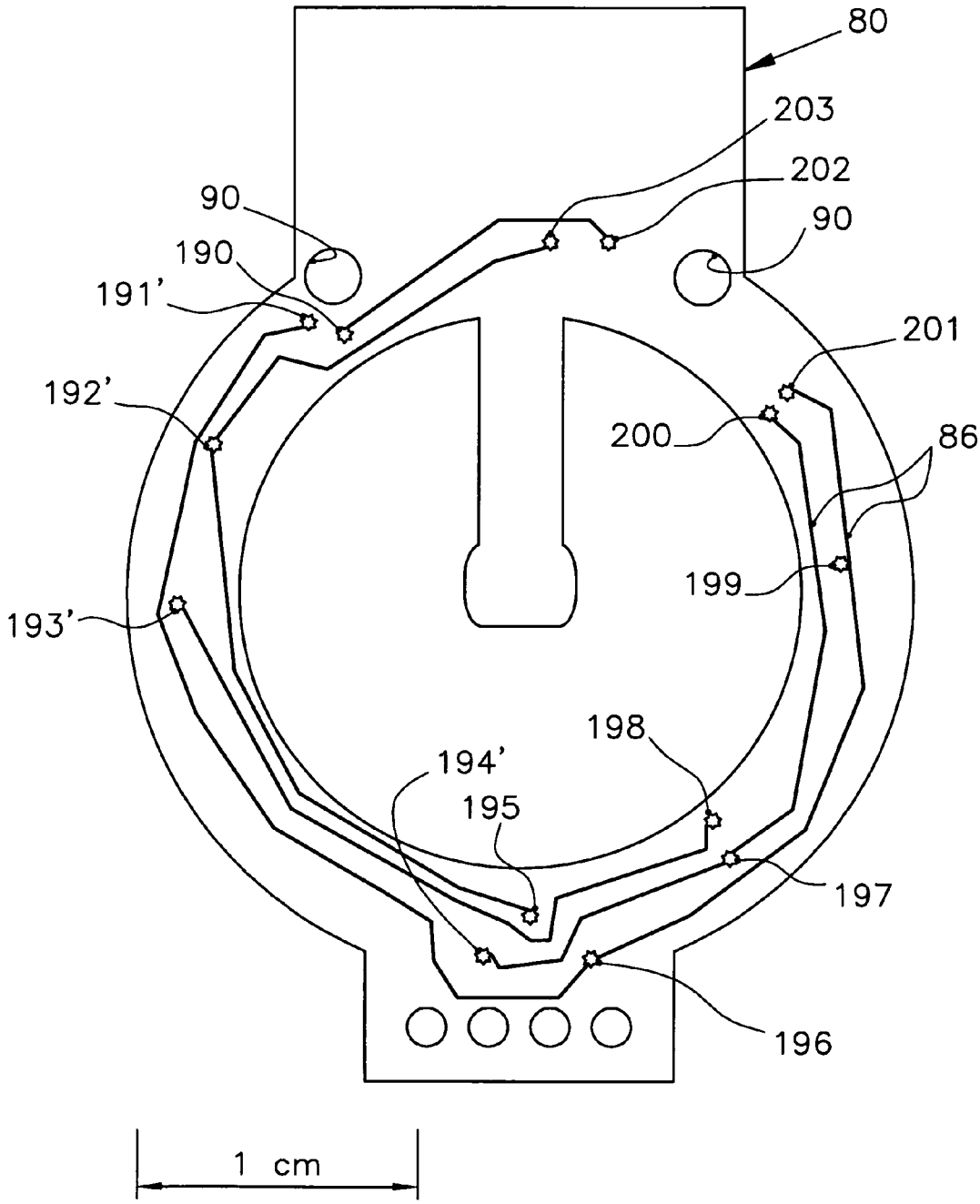
FIG. 10 shows the circuit board having the circuit of FIG. 8, from below.

FIG. 9 is a more detailed view of the upper side of circuit board 80, and FIG. 10 a more detailed view of the lower side of circuit board 80, the circuit according to FIG. 8 being arranged on circuit board 80. The components are labeled with the reference characters in accordance with FIG. 8, and the conductive tracks have also been depicted in the region of the components even though they are concealed there by them. Circuit board 80 is equipped with conductive tracks 86 on both the upper side and the lower side; and so-called through contacts 190, 191', 192', 193', 194' to 203, which for illustration have been drawn as star shapes and of course are arranged on the lower side in mirror-reversed fashion as compared with the upper side, are provided in order to connect the conductive tracks on the upper and the lower side. A scale bar is provided by way of example in order to illustrate the size relationships.

Because of the restricted space, problems have arisen in terms of arranging the components on the annular circuit board 80, and the following principles proved advantageous as a solution:

The switches (transistors, MOSFETs=Metal Oxide Semiconductor Field Effect Transistors) of the evaluation electronics for rotor position are arranged at an angular distance of, at most, 150° with respect to the annular circuit board.

1. In the context of an output stage having at least two switches (transistors, MOSFETs, etc.), the switches are arranged in an angle range of at most 150° with respect to the annular circuit board 80.
2. No electrical/electronic components, other than the conductive tracks, are arranged on the lower side of circuit board 80.
3. There is at least one angle range of the annular part 87 of circuit board 80 in which only one electrical/electronic component is arranged on it.
4. All the electrical/electronic components are arranged so that their angle ranges with respect to the annular circuit board do not overlap. Angle range 212 of component 158 is drawn by way of example.
5. There is an imaginary plane 210 (visible as line 210 in the plan view of FIG. 9) on which the rotor axis lies, and which divides the annular circuit board into two parts (or substantially bisects it), the at least one semiconductor switch 156, 172 (transistor, MOSFET, etc.) of the rotor position sensor suite being arranged on the one part, and the at least one semiconductor switch 184 (transistor, MOSFET, etc.) of the power stage being arranged on the other part.

6. In the context of a circuit board 80 having a first terminal region 81 for the winding and a second terminal region 82, located opposite first terminal region 81, for the operating voltage and optionally for the sensor contacts, imaginary plane 210 extends through first terminal region 81 and second terminal region 82. In other words, the semiconductor switch or switches for the rotor position sensor suite are arranged on the one semicircle between terminal regions 81 and 82, and the semiconductor switches for the power stage are arranged on the other semicircle.

The components, and in particular electronic components 162, 172, 184, are preferably arranged on circuit board 80 in such a way that, in a plan view of the fan along the motor axis, they are all within the housing at the corresponding point. Expressed mathematically, in the context of a plan view of the fan along motor axis 70, for each angle (i.e. around the entire circuit board; cf. angle range 212) with respect to circuit board 80, the maximum radial dimension, of electronic components 156, 172, 184 of motor electronics 88 that are located on circuit board 80, is smaller than the corresponding maximum radial dimension of housing 22, 24. The fan is thereby kept compact.

Figure 11:
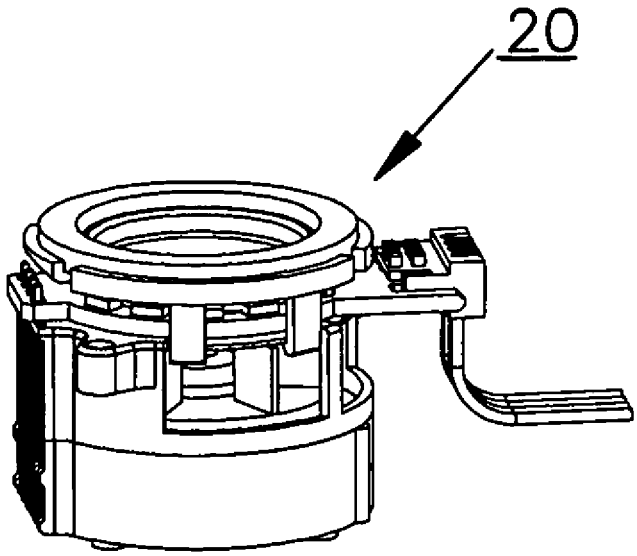
FIG. 11 depicts the fan at approximately actual size.
Figure 12:
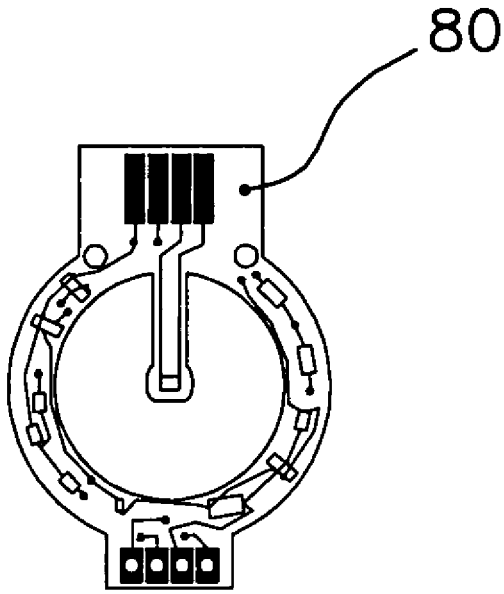
FIG. 12 depicts the circuit board at approximately actual size.

FIG. 11 and FIG. 12 are depictions of fan 20 and of circuit board 80, respectively, at approximately actual size. It is evident that these fans are very small; the term "mini-fans" is also used. Because the space available, for example, in an automobile headliner or overhead console is very limited, it is important that fan 20 not be made significantly, or preferably at all, larger in height or width as a result of circuit board 80 having the motor electronics. This is achieved by arranging circuit board 80 around air entrance opening 30; the use of SMD components 88 additionally decreases the necessary size.

Figure 13:
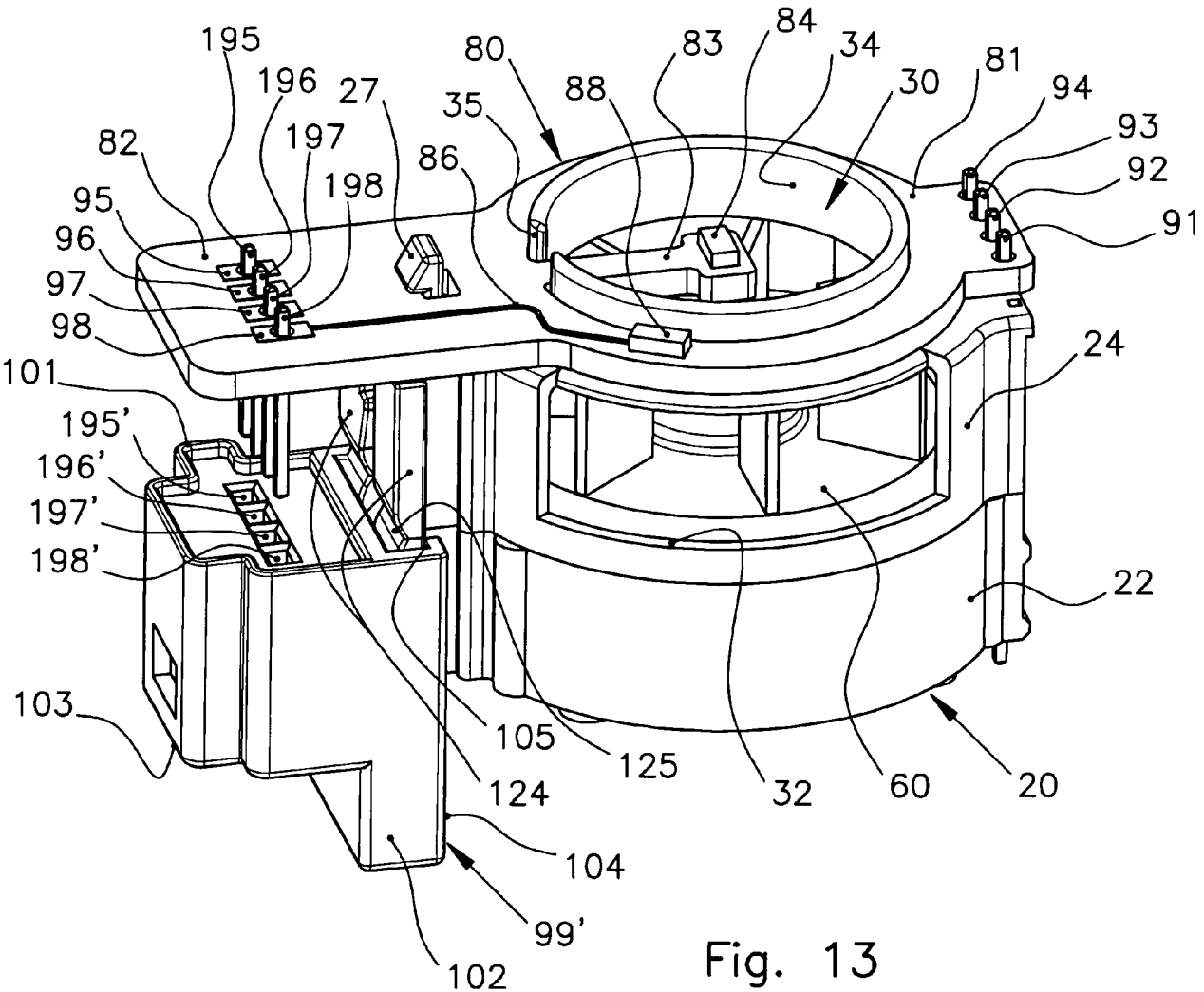
FIG. 13 is a three-dimensional depiction of the fan of FIG. 1 with a modified plug connector arrangement.
Figure 14:
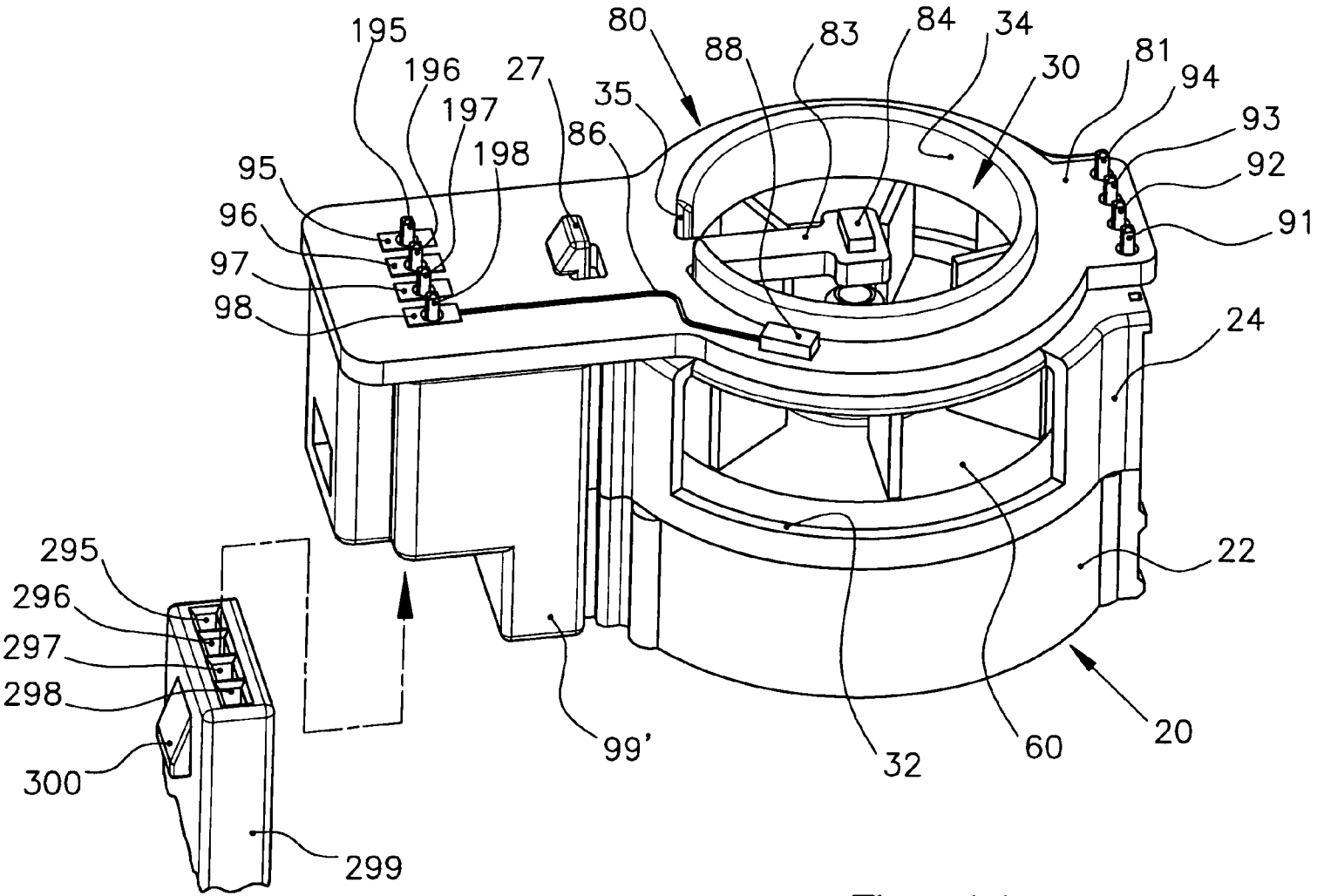
FIG. 14 is a three-dimensional depiction of the fan of FIG. 13.
Figure 15:
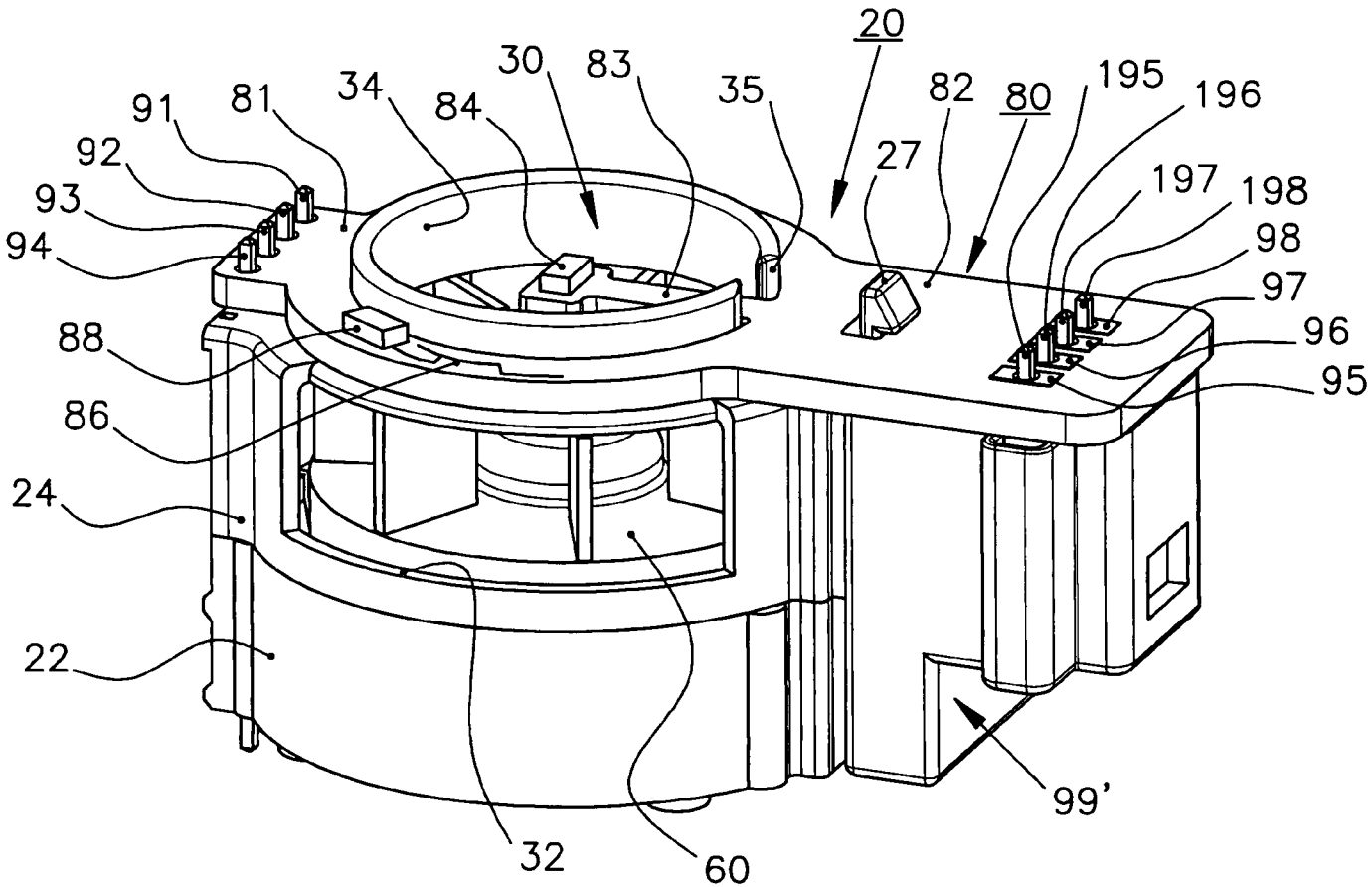
FIG. 15 is a further three-dimensional depiction of the fan of FIG. 13.

FIG. 13 to FIG. 15 show motor 20 with circuit board 80 located on top, external connection to contacts 95 (first terminal to sensor 84), 96 (second terminal to sensor 84), 97 (supply voltage +UB), and 98 (supply voltage ground) being accomplished with the aid of a plug connector housing 99' that is shown partly pulled out in FIG. 13. For plug-in connection, contact pins 195, 196, 197, 198 are inserted into contacts 95 to 98 in corresponding recesses and secured, for example using press-in technology or with a solder connection. Contact pins (terminal pins) 195 to 198 project out downward, i.e. on the motor side of circuit board 80. Plug connector housing 99' has, on upper side 101 directed toward contact pins 195 to 198, inwardly facing openings 195', 196', 197', 198' to receive contact pins 195 to 198.

On the lower side, plug connector housing 99' has an axial projection 102 and a surface 103 on which a female plug connector 299 (depicted schematically in FIG. 14), having four contact openings 295, 296, 297, 298 associated with contact pins 195 to 198, is inserted into plug connector housing 99' and latched thereto by way of a latch element 300. Plug connector 299 serves to connect the fan to a control unit, e.g. for an air conditioning system.

Plug connector 99' has, on the inner lateral surface 104 associated with fan 20, one or more guidance openings 105; and one or more guidance members 124, in particular guidance rails, having one or more latching depressions 125, are provided on housing 22, 24 of fan 20.

The interaction of guidance member 124 with guidance opening 105 of plug connector 99' produces linear, axial guidance of the plug connector, the axial guidance preferably occurring parallel to motor axis 70. In the final state, plug connector 99' latches via a plug-in latching element (not depicted) into latching depression (latch-in region, latch element) 125, and ensures secure retention of plug connector 99' on fan 20.

As a result of the axial guidance system 105, 124 and the latching element (not depicted), flexural forces on contact pins 195 to 198, and therefore possible damage to circuit board 80, are largely avoided. In this context, latching member 27 ensures a good mechanical connection between circuit board 80 and upper housing part 24.

The use of plug connector housing 99' enables simple adaptation of the fan to a customer's stipulations for plug connector 299. Plug connector housing 99' can be additionally secured, for example, using laser technology.

Many modifications and variants, within the scope of this invention, are of course possible.

The motor described represents a preferred embodiment; the motor type is, however, not limited to a claw-pole motor, and the stator can, for example, also have two strands, three strands, four strands, five strands, six strands, or even more strands, and it can, for example, also be implemented in star or delta fashion. Instead of the sensor coil it is also possible, for example, to use a Hall sensor or, in the context of a stator having a plurality of strands, a strand not used in that instance for current flow.

The circuit board having the at least one recess 89 can be implemented in either continuous or open fashion, for example like a semicircle, three-quarter circle, or in a U shape.

For applications with stringent mechanical requirements, connection via a plug connector 99 can be safety-critical, and other connections such as, for example, solder connections or connections via contact pins can then be used.

What is claimed is:

1. A fan (20) comprising: a motor having a housing (22, 24), a stator (40) and a rotor (60) with at least one fan blade (68); said housing defining at least one air inlet (29) having an air entrance opening (30, 102) for intake of air and at least one air outlet (37) having an air exit opening (32) for discharge of air (31); a flat circuit board (80) formed with at least one recess (89), which circuit board (80) is arranged adjacent the air inlet (29) in such a way that air can enter the fan (20) through the recess (89), a first portion (87) of the circuit board (80) being arranged adjacent a periphery of the air inlet (29), motor electronics (88) being arranged on the first portion of the circuit board (80), said motor electronics including a power stage having at least one semiconductor switch, being arranged on the first portion (87) of the circuit board (80).

2. The fan according to claim 1, wherein the circuit board (80) is arranged, at least in part, around the air inlet (29).

3. The fan according to claim 2, wherein said first portion (87) of the circuit board (80) is annular and is arranged around the air inlet (29).

4. The fan according to claim 1, wherein a second portion (83) of the circuit board projects, at least in part, into the air entrance opening (30, 102), and at least one component (84), for measuring a parameter of said air, is arranged in the opening, on that second circuit board portion (83).

5. The fan according to claim 4, wherein the second portion (83) comprises at least one conductive track (85) that is connected to the measuring component (84).

6. The fan according to claim 1, in which the circuit board (80) is mechanically connected to the air inlet (29).

7. The fan according to claim 6, in which the mechanical connection comprises at least one latching connection (27).

8. The fan according to claim 1, in which the stator (40) comprises at least one winding (44); and in which winding ends (48', 48", 49', 49") are electrically connected to respective contacts (191, 192, 193, 194) on the circuit board (80).

9. The fan according to claim 8, in which the winding (44) is wound in a bifilar configuration.

10. The fan according to claim 8, in which for electrical connection, axially extending contact elements (91, 92, 93, 94) are provided on the radial outer side of the fan (20).

11. The fan according to claim 10, in which the axially extending contact elements (91, 92, 93, 94) are contacted to the contacts (191, 192, 193, 194) on the circuit board (80).

12. The fan according to claim 8, wherein the circuit board (80) further comprises terminals (97, 98) for voltage supply which are located opposite the contacts (191, 192, 193, 194) on the circuit board (80) for electrical connection to the at least one winding (44).

13. The fan according to claim 8, wherein the circuit board (80) comprises terminals (95, 96), for electrical connection to a measuring component (84), which are located opposite the respective contacts (191, 192, 193, 194) on the circuit board (80) for electrical connection to the at least one winding (44).

14. The fan according to claim 1, wherein the air inlet (29) is defined by a collar (34) that delimits the air entrance opening (30, 102).

15. The fan according to claim 1, further comprising a shaped plastic part (100), configured with a region (105) at least partly covering the circuit board (80), which is arranged on a side face of the circuit board, facing away from the stator (40).

16. The fan according to claim 15, wherein the distance between the circuit board (80) and the covering region (105) is between 0.8 mm and 7 mm at at least one point.

17. The fan according to claim 1, further comprising an electronic evaluation system for detecting angular rotor position, having at least two semiconductor switches (156, 172), arranged on the circuit board, the semiconductor switches (156, 172) being arranged around the at least one recess (89) at an angular separation of at most 150° from each other.

18. The fan according to claim 1, wherein there exists, on a region of the circuit board (80) located outside the air entrance opening (30), at least one angle range (212) in which only one electronic component (88) is arranged.

19. The fan according to claim 1, wherein said fan housing (22, 24) is formed with a flat region (36) on which the circuit board (80) is arrangeable.

20. The fan according to claim 1, further comprising a shaped plastic part (100), adapted for sealing the air entrance opening (30), which is arranged on a side face of the circuit board (80), facing away from the stator (40).

21. The fan according to claim 1, wherein the at least one air inlet (29) is formed with an air entrance opening (30, 102) for axial intake of air (31).

22. The fan according to claim 1, wherein the at least one air outlet (37) is formed with an air exit opening (32) for radial discharge of air (31).

23. The fan according to claim 15, wherein said covering region (105) of said shaped plastic part (100) is spaced at least 0.2 mm from components (88) mounted on said circuit board (80).

24. The fan according to claim 3, wherein said annular first portion (87) of the circuit board (80) is configured with a first semicircle sector and a second semicircle sector, separated by an imaginary plane (210) coinciding with a motor axis (70), and wherein electronic components serving as a rotor position sensor are arranged in said first semicircle sector and electronic components serving as a power switching stage for said motor are arranged in said second semicircle sector.

25. The fan according to claim 1, wherein said power stage has at least two semiconductor switches, arranged on the circuit board (80), the semiconductor switches being arranged around the at least one recess (89) at an angular separation of at most 150° from each other.

* * * * *